US009915068B2

(12) United States Patent
Kim

(10) Patent No.: US 9,915,068 B2
(45) Date of Patent: Mar. 13, 2018

(54) SOLID REINFORCED CONCRETE COLUMN BASED ON ARRANGEMENT OF TRIANGULAR REINFORCING BAR NETWORKS AND METHOD OF CONSTRUCTING THE SAME

(71) Applicant: SAMSUNG C&T CORPORATION, Seongnam-si, Gyeonggi-do (KR)

(72) Inventor: Tae Hoon Kim, Seongnam-si (KR)

(73) Assignee: SAMSUNG C&T CORPORATION, Seongnam-si, Gyeonggi-Do (KR)

( * ) Notice: Subject to any disclaimer, the term of this patent is extended or adjusted under 35 U.S.C. 154(b) by 0 days.

(21) Appl. No.: 15/030,074

(22) PCT Filed: Nov. 27, 2013

(86) PCT No.: PCT/KR2013/010847
§ 371 (c)(1),
(2) Date: Apr. 18, 2016

(87) PCT Pub. No.: WO2015/064821
PCT Pub. Date: May 7, 2015

(65) Prior Publication Data

US 2016/0251856 A1 Sep. 1, 2016

(30) Foreign Application Priority Data

Nov. 4, 2013 (KR) ..... 10-2013-0132884

(51) Int. Cl.
*E04C 3/20* (2006.01)
*E04C 3/34* (2006.01)
(Continued)

(52) U.S. Cl.
CPC ..... *E04C 3/34* (2013.01); *E01D 19/02* (2013.01); *E04C 5/06* (2013.01); *E04C 5/0604* (2013.01);
(Continued)

(58) Field of Classification Search
CPC ... E04C 3/34; E04C 5/06; E04G 21/02; E04G 21/125; E04G 21/142
See application file for complete search history.

(56) References Cited

U.S. PATENT DOCUMENTS 893,792 A * 7/1908 Gabriel ..... E04C 3/34 52/649.2
3,245,190 A * 4/1966 Reiland ..... E04C 3/34 52/649.3
(Continued)

FOREIGN PATENT DOCUMENTS

JP H11-036232 A 2/1999
JP 2005-076203 A 3/2005
(Continued)

*Primary Examiner* — Gisele D Ford
(74) *Attorney, Agent, or Firm* — Rabin & Berdo, P.C.

(57) ABSTRACT

A solid reinforced concrete column and a method of constructing the same are disclosed. The solid reinforced concrete column includes outer main reinforcing bars, inner reinforcing bars, inner transverse reinforcing bars, outer transverse reinforcing bars, and concrete. The outer main reinforcing bars are arranged in an axial direction. The inner reinforcing bars are each arranged to be placed between two or three of the outer main reinforcing bars inside the two or three outer main reinforcing bars in the axial direction. The inner transverse reinforcing bars are each arranged to connect the two or three outer main reinforcing bars and the inner reinforcing bar in a transverse direction. The outer transverse reinforcing bars are arranged to surround the outer main reinforcing bars outside the outer main reinforcing bars in the transverse direction. The concrete is placed to bury the reinforcing bars.

16 Claims, 5 Drawing Sheets

(51) Int. Cl.

| | |
|---|---|
| ***E01D 19/02*** | (2006.01) |
| ***E04C 5/06*** | (2006.01) |
| ***E04G 21/02*** | (2006.01) |
| ***E04G 21/12*** | (2006.01) |
| ***E04G 21/14*** | (2006.01) |

(52) U.S. Cl.
CPC ..... *E04C 5/0627* (2013.01); *E04G 21/02* (2013.01); *E04G 21/125* (2013.01); *E04G 21/142* (2013.01)

(56) References Cited

U.S. PATENT DOCUMENTS 3,375,632 A * 4/1968 Congy ..... B21F 27/125 52/637
3,744,207 A * 7/1973 Oroschakoff ..... B21F 27/121 52/649.3
3,890,756 A * 6/1975 Wagner ..... E04C 5/064 52/649.2
4,031,685 A * 6/1977 Heinz ..... B21F 27/125 138/176
6,293,071 B1 * 9/2001 Konstantinidis ..... E04C 5/02 52/659
7,421,827 B1 * 9/2008 Konstantinidis ..... E04C 5/0604 52/252
9,151,054 B2 * 10/2015 Gulikov ..... E04C 5/0618
9,199,298 B2 * 12/2015 Bernardinis ..... B21F 27/121
2002/0026764 A1 * 3/2002 Sachs ..... E04C 3/20 52/834
2004/0231278 A1 * 11/2004 Yin ..... E04C 5/0618 52/649.4
2004/0237435 A1 * 12/2004 Yurkevich ..... E02D 5/48 52/378
2004/0237449 A1 * 12/2004 Gulikov ..... E04C 5/0609 52/633
2005/0016111 A1 * 1/2005 Knepp ..... E02D 27/42 52/633
2006/0207211 A1 * 9/2006 Yin ..... E04C 3/34 52/837
2007/0175166 A1 * 8/2007 Ley ..... E01D 2/00 52/649.2
2009/0178356 A1 * 7/2009 Baumann ..... E04C 3/34 52/414
2013/0104492 A1 * 5/2013 Hung ..... E04B 5/38 52/664

FOREIGN PATENT DOCUMENTS

KR 20-0233599 Y1 9/2001
KR 10-2003-0006681 A 1/2003
KR 10-2012-0114044 A 10/2012

* cited by examiner

SOLID REINFORCED CONCRETE COLUMN BASED ON ARRANGEMENT OF TRIANGULAR REINFORCING BAR NETWORKS AND METHOD OF CONSTRUCTING THE SAME

BACKGROUND

1. Technical Field

The present invention relates to a solid reinforced concrete column having a new reinforcing bar arrangement structure and a method of constructing the same, which are capable of omitting or reducing cross tie reinforcing bars that traverse the sections of the solid reinforced concrete column that is completely filed with concrete.

2. Description of the Related Art

Architectural and civil engineering structures, such as bridges, etc., generally employ a reinforced concrete structure. A solid reinforced concrete column is a reinforced concrete column completely filled with concrete, and is distinguished from a hollow reinforced concrete column in which an empty space is formed.

Meanwhile, with the imposition of strict earthquake-resistant design, columns are often designed to have a structure that receives a downward load as axial force and then transfers the received load to the ground and that also chiefly resists a lateral load, such as an earthquake. In the design of the structure of a square column, when confinement reinforcing bars, such as cross tie reinforcing bars 13, strip reinforcing bars 14, etc, are arranged in the transverse direction of the column, as shown in FIG. 1, an actuation moment reaches the maximum resistive moment of the section of the column in the case of the occurrence of an earthquake, and then a plastic hinge occurs, thereby exhibiting plastic behavior. The design that is contrived to produce plastic behavior is referred to as plastic design. The plastic design can generally obtain economic design results compared to elastic design. In practice, the design of a solid reinforced concrete column, such as that of FIG. 1, is being applied to buildings and civil engineering structures for economic and structural reasons. Actually, bridge design specifications and concrete structure specifications regarding confinement transverse reinforcing bar details have been made and widely applied.

Meanwhile, the design of a column, such as that of FIG. 1, has a disadvantage in that the efficiency of construction is decreased due to cross tie reinforcing bars 13. In other words, the cross tie reinforcing bars 13 need to be arranged to traverse the sections of a column at a construction site. This arrangement task is considerably cumbersome, and also requires a long task time. Furthermore, in some cases, the arrangement needs to be performed in the state of holding main reinforcing bars 11 using a crane in order to prevent the main reinforcing bars 11 from collapsing, and thus the efficiency of use of the crane is decreased. Furthermore, the cross tie reinforcing bars 13 make the placement of concrete difficult due interference with concrete aggregates.

SUMMARY

The present invention has been developed to overcome the problem in which a conventional solid reinforced concrete column is difficult to construct due to interference with the arrangement of cross tie reinforcing bars, and an object of the present invention is to provide a solid reinforced concrete column having a new reinforcing bar arrangement structure, which enables cross tie reinforcing bars, traversing the sections of the column, to be omitted or reduced.

Another object of the present invention is to provide a method of constructing a solid reinforced concrete column, which can improve the efficiency of construction and shorten the period of construction through the modularization of the arrangement of reinforcing bars.

In accordance with an aspect of the present invention, there is provided a solid reinforced concrete column, including: outer main reinforcing bars arranged in the axial direction of the solid reinforced concrete column; inner reinforcing bars each arranged to be placed between two or three of the outer main reinforcing bars inside the two or three outer main reinforcing bars in the axial direction; inner transverse reinforcing bars each arranged to connect the two or three outer main reinforcing bars and the inner reinforcing bar, placed between the two or three outer main reinforcing bars, in the transverse direction of the solid reinforced concrete column, thereby forming each triangular reinforcing bar network; outer transverse reinforcing bars arranged to surround the outer main reinforcing bars outside the outer main reinforcing bars in the transverse direction; and concrete placed to bury the outer main reinforcing bars, the inner reinforcing bars, the inner transverse reinforcing bars, and the outer transverse reinforcing bars.

In accordance with another aspect of the present invention, there is provided a method of constructing a solid reinforced concrete column, including: a first step of assembling each triangular reinforcing bar network by connecting two or three outer main reinforcing bars and a single inner reinforcing bar by inner transverse reinforcing bars; a second step of arranging reinforcing bars by arranging a plurality of triangular reinforcing bar networks and then surrounding the outside of the plurality of triangular reinforcing bar networks with outer transverse reinforcing bars; and a third step of placing concrete so that the reinforcing bars arranged at the second step are buried in the concrete.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

The present invention will be described in detail below with reference to the accompanying drawings and preferred embodiments.

Figure 1:
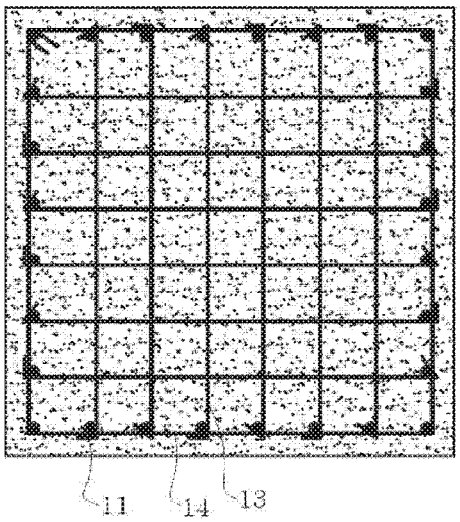
FIG. 1 is a sectional view of a conventional solid reinforced concrete column.
Figure 2:
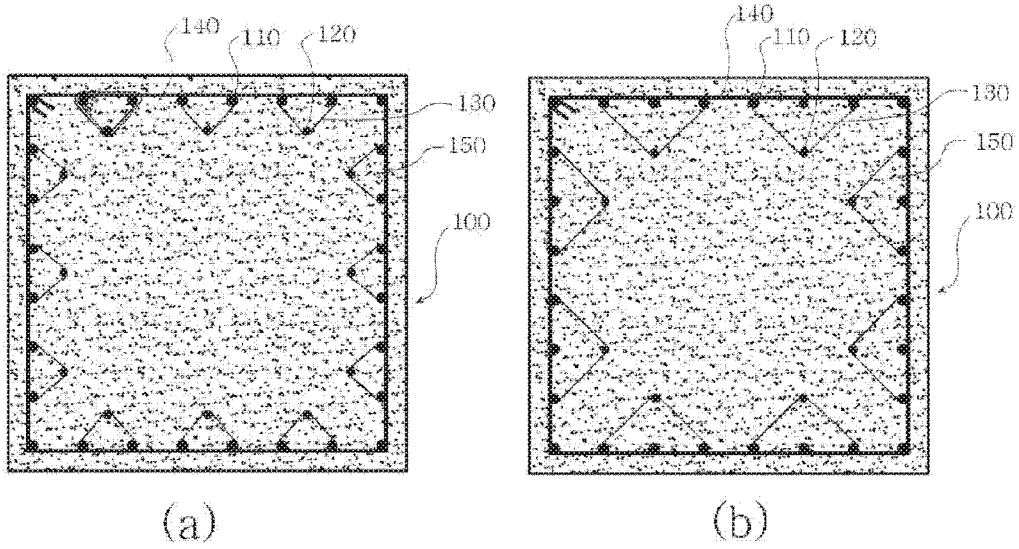
FIG. 2 is a sectional view of a solid reinforced concrete column according to the present invention.

FIG. 2 is a sectional view of a solid reinforced concrete column 100 according to the present invention. The present invention is characterized in that in the solid reinforced concrete column 100 completely filled with concrete 150, reinforcing bars are arranged in such a way as to form each triangular reinforcing bar network using two or three outer main reinforcing bars 110, a single inner reinforcing bar 120 and inner transverse reinforcing bars 130. Although a squire column is illustrated as an example of the solid reinforced concrete column 100 in the present specification, hexagon, octagon, track-type columns, etc. may be used when cross tie reinforcing bars are arranged.

More specifically, the solid reinforced concrete column 100 according to the present invention includes: outer main reinforcing bars 110 arranged in the axial direction of the solid reinforced concrete column 100; inner reinforcing bars 120 arranged in the axial direction such that each of the inner reinforcing bars 120 is placed between two or three of the outer main reinforcing bars 110 inside the two or three outer main reinforcing bars 110; inner transverse reinforcing bars 130 arranged such that each of the inner transverse reinforcing bars 130 connects the two or three outer main reinforcing bars 110 and the inner reinforcing bar 120 placed between the two or three outer main reinforcing bars 110 in the transverse direction of the solid reinforced concrete column 100, thereby forming each triangular reinforcing bar network; outer transverse reinforcing bars 140 arranged to surround the outer main reinforcing bars 110 outside the outer main reinforcing bars 110 in the transverse direction; and concrete 150 placed to bury the outer main reinforcing bars 110, the inner reinforcing bars 120, the inner transverse reinforcing bars 130, and the outer transverse reinforcing bars 140. FIG. 2(*a*) shows an example in which a smaller triangular reinforcing bar network is formed using two outer main reinforcing bars 110, and FIG. 2(*b*) shows an example in which a larger triangular reinforcing bar network is formed using three outer main reinforcing bars 110. Meanwhile, the inner reinforcing bar 120 may be designed as main reinforcing bars for a column, or may be designed as simple reinforcing bars for assembly that are used to form networks along with the outer main reinforcing bars 110.

The solid reinforced concrete column 100 configured as described above can achieve the three-axis confinement of concrete and also can advantageously resist brittle fracture because the outer transverse reinforcing bars 140 and the inner transverse reinforcing bars 130 produce confining stresses in stable triangular arrangements, with the result that stable earthquake-resistant details even when cross tie reinforcing bars are omitted or reduced. The above-described solid reinforced concrete column 100 according to the present invention may be applied to the columns of a building, the piers of a bridge, etc.

In the present invention, the connection of the outer main reinforcing bars 110 and the inner reinforcing bars 120 and the hooked end processing of the inner transverse reinforcing bars 130 and the outer transverse reinforcing bars 140 may be performed in accordance with common methods (bridge design specifications), and the outer transverse reinforcing bars 140 may be implemented as closed strip-shaped reinforcing bars or spiral reinforcing bars in accordance with common methods. For example, in a plastic hinge section, the outer main reinforcing bars 110 and the inner reinforcing bars 120 are completely mechanically connected without a lap splice, and, in the section other than the plastic hinge section, the lap splices of the outer main reinforcing bars 110 and the inner reinforcing bars 120 do not exceed ½ thereof. Furthermore, when the outer transverse reinforcing bars 140 are implemented as closed strip-shaped reinforcing bars, both ends thereof are configured in the form of 135° hooks having an extended length larger than the larger one of a value six times the diameter thereof and 80 mm. In contrast, when the outer transverse reinforcing bars 140 are implemented as spiral reinforcing bars, both ends thereof are configured in the form of 135° hooks having an extended length larger than the larger one of a value six times the diameter thereof and 80 mm, these hooks are arranged to be caught on the main reinforcing bars, and mechanical connection or complete welding connection is used instead of lap splicing in a plastic hinge section. Furthermore, the hooks of the inner transverse reinforcing bars 130 are configured to be caught on the outer main reinforcing bars 110. When the inner transverse reinforcing bars 130 are successively caught on the same outer main reinforcing bar 110, both ends of the successive inner transverse reinforcing bars 130 are changed to prevent 90° hooks from being successively caught.

Figure 3:
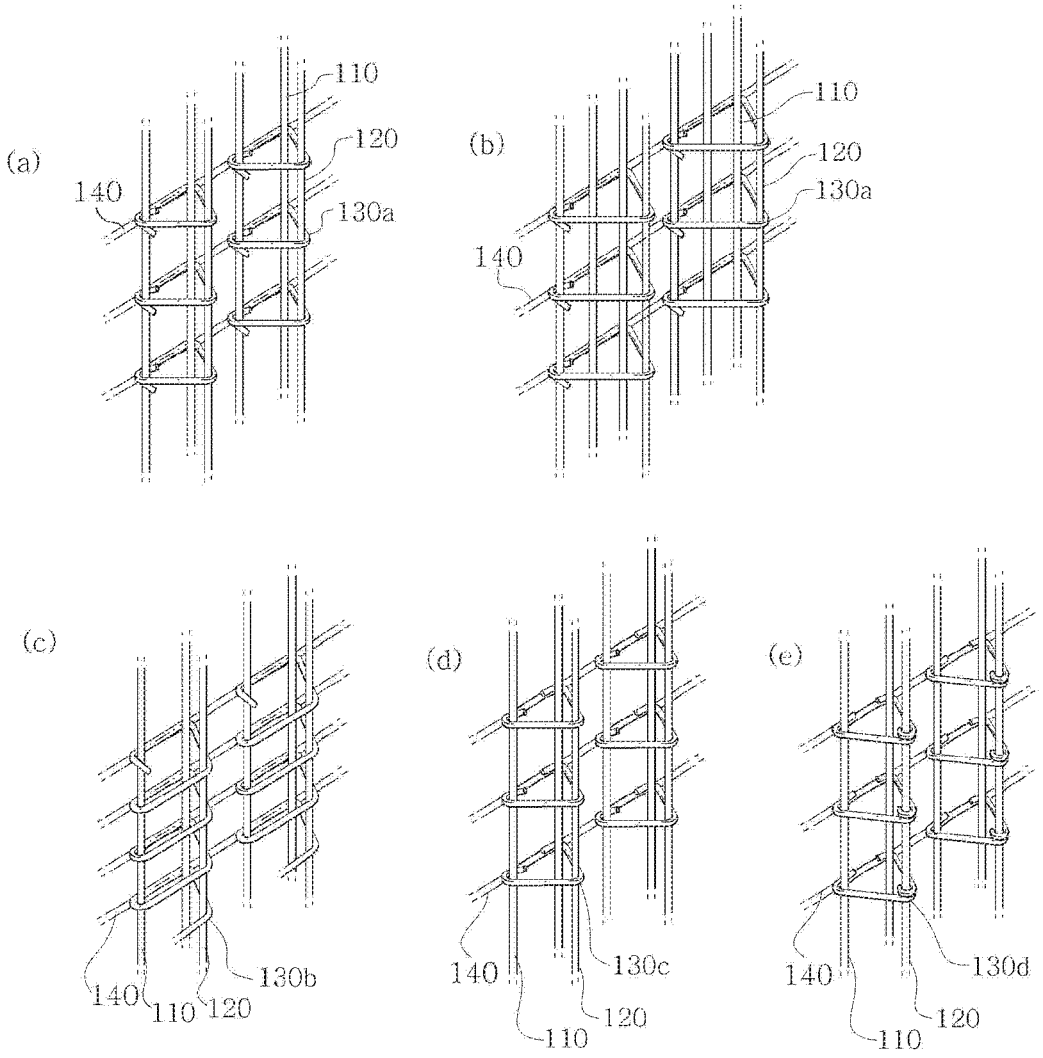
FIG. 3 shows various embodiments of the arrangement details of triangular reinforcing bar networks in a solid reinforced concrete column according to the present invention.

FIG. 3 shows various embodiments of the arrangement details of the triangular reinforcing bar networks of the solid reinforced concrete column 100 according to the present invention. FIG. 3(*a*) shows an example in which inner transverse reinforcing bars 130 that connect two outer main reinforcing bars 110 and a single inner reinforcing bar 120 are implemented as closed strip-shaped reinforcing bars 130*a*, and FIG. 3(*b*) shows an example in which inner transverse reinforcing bars 130 that connect three outer main reinforcing bars 110 and a single inner reinforcing bar 120 are implemented as closed strip-shaped reinforcing bars 130*a*. FIG. 3(*c*) shows an example in which the inner transverse reinforcing bars 130 of FIG. 3(*b*) are replaced with spiral reinforcing bars 130*b*, and FIGS. 3(*d*) and 3(*e*) shows examples in which the inner transverse reinforcing bars 130 are replaced with non-closed reinforcing bars 130*c* or 130*d*. In FIGS. 3(*d*) and 3(*e*), non-closed reinforcing bars 130*c* and 130*d* are arranged to connect outer main reinforcing bars 110 and inner reinforcing bars 120 but not to connect the outer main reinforcing bars 110 with each other, and complete triangular networks along with outer transverse reinforcing bars 140. The non-closed reinforcing bars 130*c* and 130*d* are named after the fact that they do not connect the outer main reinforcing bar 110 with each other. From FIG. 3(*d*), inverted V-shaped non-closed reinforcing bars 130*c* each having hooks at both ends thereof are found. Reinforcing bars are arranged such that in each network, a single non-closed reinforcing bar 130*c* surrounds a single inner reinforcing bar 120 and is hooked to two outer main reinforcing bars 110. From FIG. 3(*e*), linear non-closed reinforcing bars 130*d* each having hooks at both ends thereof are found. Reinforcing bars are arranged such that in each network, two outer main reinforcing bars 110 and a single inner reinforcing bar 120 are connected by two non-closed reinforcing bars 130*d*. However, the non-closed reinforcing bars 130*c* or 130*d* need to be arranged to be connected to the outer transverse reinforcing bars 140, in which case an adequate confinement effect can be achieved by the non-closed reinforcing bars 130*c* or 130*d*. Although not shown, the inner transverse reinforcing bar 130 may be replaced with spiral reinforcing bars or non-closed reinforcing bars in FIG. 3(*b*), as shown in FIGS. 3(*c*) to 3(*e*).

Figure 4:
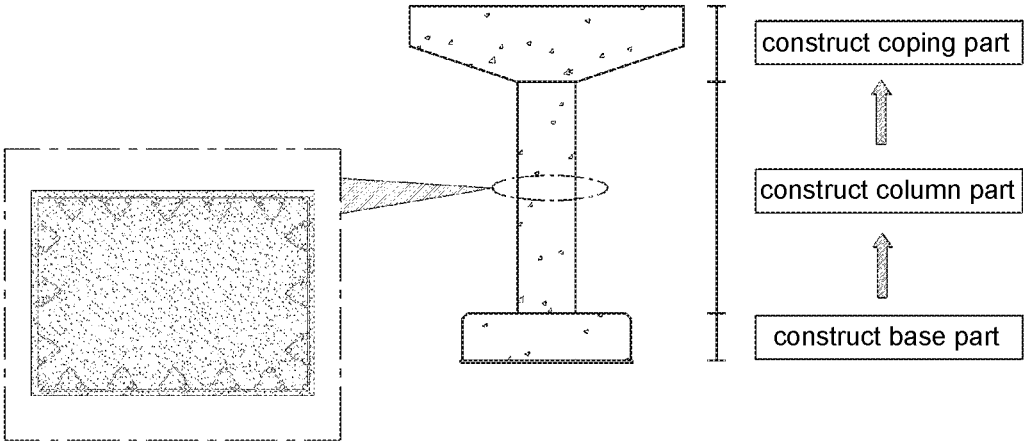
FIG. 4 is a flowchart of a method of constructing a solid reinforced concrete column according to the present invention.
Figure 5:
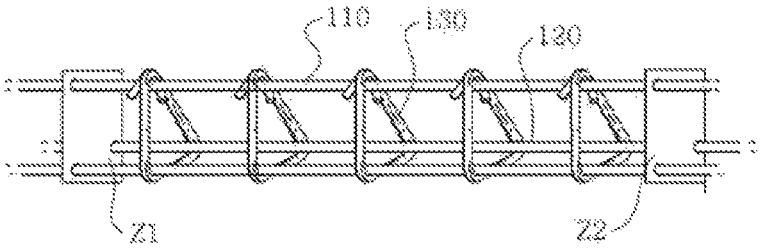
FIG. 5 shows the state of the assembly of a triangular reinforcing bar network using a jig in a method of constructing a solid reinforced concrete column according to the present invention.
Figure 6:
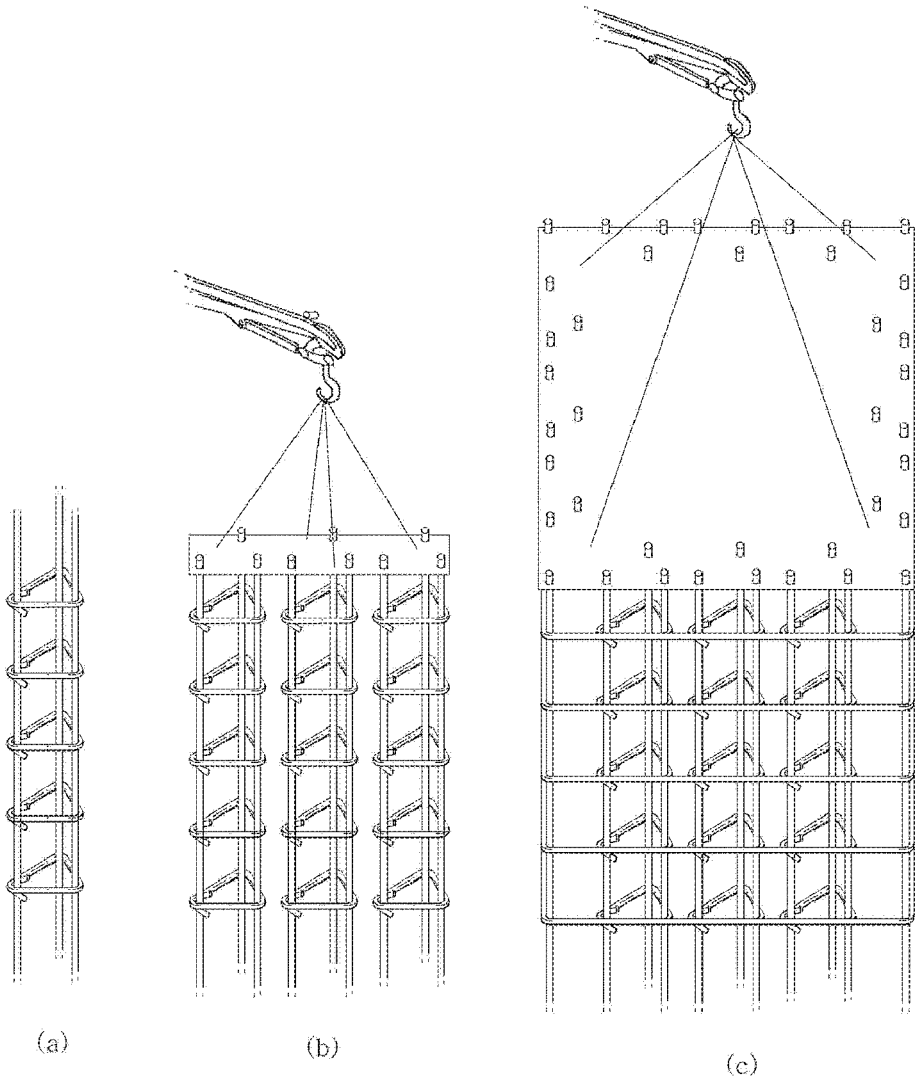
FIG. 6 shows various embodiments of a method of installing a triangular reinforcing bar network in a method of constructing a solid reinforced concrete column according to the present invention.
Figure 7:
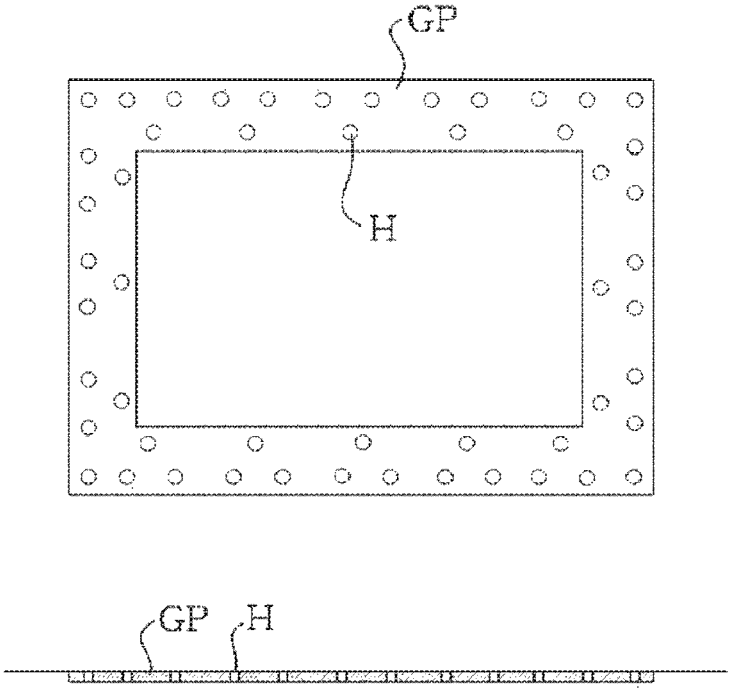
FIG. 7 shows the state of the installation of a guide plate in a method of constructing a solid reinforced concrete column according to the present invention.

Meanwhile, the present invention proposes a preferred method of constructing the solid reinforced concrete column 100. FIG. 4 illustrates a solid reinforced concrete pier that is divided into a base part, a column part, and a coping part. FIGS. 5 to 7 show the details of the construction of a reinforced concrete column according to the present invention solid using the solid reinforced concrete column of FIG. 2(*a*) as an example. The method of constructing solid reinforced concrete column 100 according to the present invention is described in a stepwise manner with reference to FIGS. 5 to 7.

First, each triangular reinforcing bar network is assembled by connecting two or three outer main reinforcing bars 110 and a single inner reinforcing bar 120 by inner transverse reinforcing bars 130 (a first step). The triangular reinforcing bar network may be simply assembled using a pair of jigs Z1 and Z2, as shown in FIG. 5. That is, in the state in which the two or three outer main reinforcing bars 110 and the one inner reinforcing bar 120 have been fastened to the pair of jigs Z1 and Z2, the triangular reinforcing bar network is assembled by connecting the two or three outer main reinforcing bars 110 and the one inner reinforcing bar 120 by the inner transverse reinforcing bars 130.

Thereafter, triangular reinforcing bar networks and outer transverse reinforcing bars 140 are installed at the location of a column (a second step). The methods of the present step may be classified into three methods, as shown in FIG. 6. A first method is a method of assembling triangular reinforcing bar networks and outer transverse reinforcing bars 140 at the location of a column. This method is a method using a triangular reinforcing bar network as a single construction module. That is, a plurality of triangular reinforcing bar networks is arranged and installed at the location of a column in the form of a column (see FIG. 6(*a*)), and then the triangular reinforcing bar networks are surrounded with outer transverse reinforcing bars 140.

A second method is a method of assembling a column reinforcing bar network by surrounding triangular reinforcing bar networks with outer transverse reinforcing bars 140 and installing the column reinforcing bar network at the location of a column. This method is a method using a column reinforcing bar network as a single construction module. That is, a column reinforcing bar network is assembled by arranging all triangular reinforcing bar networks to be arranged in a square column to be constructed and outer main reinforcing bars required and surrounding the triangular reinforcing bar networks with outer transverse reinforcing bars 140, and then the column reinforcing bar network is lifted and installed at the location of a column using a crane (see FIG. 6(*c*)).

A third method is a hybrid method of the first and second methods. This method is a method of lifting a plurality of triangular reinforcing bar networks arranged on a single side by means of a dedicated jig using a crane at one time and installing the triangular reinforcing bar networks at the location of a column. That is, a plurality of triangular reinforcing bar networks to be arranged on each side of a square column is simultaneously lifted by means of a dedicated jig using a crane and installed at the location of a column (see FIG. 6(*b*)), outer main reinforcing bars, inner reinforcing bars and inner transverse reinforcing bars are all installed, and then the triangular reinforcing bar networks are surrounded by outer transverse reinforcing bars 140.

As described above, in the present invention, the outer main reinforcing bars 110 and the inner reinforcing bars 120 are installed in a self-standing state in the form of a triangular reinforcing bar network, a column reinforcing bar network or the like, and thus may be stably installed without concern about collapse.

Meanwhile, when the second step is performed by inserting the outer main reinforcing bars 110 or inner reinforcing bars 120 into the reinforcing bar receiving holes H of a guide plate GP after the guide plate GP in which the reinforcing bar receiving holes H are formed has been buried in the upper portion of a base part (see FIG. 7), the task of arranging reinforcing bars can be more easily achieved.

Finally, the concrete 150 is placed such that the reinforcing bars installed at the second step are buried (a third step). This completes the solid reinforced concrete column 100.

According to the present invention, the following advantages are expected:

First, in a solid reinforced concrete column, a sufficient confinement effect can be achieved by arranging triangular reinforcing bar networks each composed of two or three outer main reinforcing bars, a single inner reinforcing bar and inner transverse reinforcing bars, and thus cross tie reinforcing bars that traverse the sections of the column can be omitted or reduced, thereby economically constructing a solid column.

Second, the amount of material can be reduced due to economic section design, and thus construction costs can be reduced and also the emission of carbon can be reduced.

Third, cross tie reinforcing bars that are difficult to arrange can be omitted or reduced, and thus the efficiency of the task of arranging reinforcing bars can be improved and the period of construction can be shortened. In particular, components can be modularized in the form of self-standing structures, such as triangular reinforcing bar networks or the like, in the arrangement of the reinforcing bars, and thus construction can be stably and simply performed without concern about the collapse of the reinforcing bars. Furthermore, when a crane-dedicated jig is employed, it is possible to conveniently perform the task of arranging reinforcing bars while simultaneously lifting a plurality of triangular reinforcing bar networks for a single column.

Although the present invention has been described in detail with reference to specific embodiments, these embodiments are intended to merely illustrate the present invention. Accordingly, substitutions, additions and modifications that are made without departing from the technical spirit of the present invention should be also construed as falling within the range of protection of the present invention that is defined by the following claims.

What is claimed is:

1. A solid reinforced concrete column, comprising:

outer main reinforcing bars arranged in an axial direction of the solid reinforced concrete column;

inner reinforcing bars arranged in the axial direction and located interior of the outer main reinforcing bars;

inner transverse reinforcing bars each connecting two or three outer main reinforcing bars and a single one of the inner reinforcing bars, which is placed adjacent to the two or three outer main reinforcing bars, in a transverse direction of the solid reinforced concrete column, thereby forming a plurality of triangular reinforcing bar networks;

outer transverse reinforcing bars surrounding the outer main reinforcing bars outside the outer main reinforcing bars in the transverse direction; and concrete burying the outer main reinforcing bars, the inner reinforcing bars, the inner transverse reinforcing bars, and the outer transverse reinforcing bars, wherein, when taken from a sectional view of the solid reinforced concrete column taken by a cutting plane perpendicular to the axial direction, an area interior of the outer transverse reinforcing bars is entirely filled with the concrete, wherein the inner reinforcing bars are securely connected to the inner transverse reinforcing bars, such that the inner reinforcing bars are not connected to the outer transverse reinforcing bars.

2. The solid reinforced concrete column of claim 1, wherein the inner reinforcing bars are designed as column main reinforcing bars.

3. The solid reinforced concrete column of claim 1, wherein the single one of the inner reinforcing bars includes an inner side which faces a center of the concrete column and an outer side opposite to the inner side, the inner side being connected to and in contact with a corresponding one of the inner transverse reinforcing bars, the outer side being surrounded by the concrete without being connected to another transverse reinforcing bar.

4. A method of constructing the solid reinforced concrete column of claim 1, comprising:

a first step of assembling each triangular reinforcing bar network by connecting the two or three outer main reinforcing bars and the single one of the inner reinforcing bars by each of the inner transverse reinforcing bars; then a second step of arranging the plurality of triangular reinforcing bar networks and then surrounding an outside of the plurality of triangular reinforcing bar networks with the outer transverse reinforcing bars; and then a third step of placing the concrete such that the outer main reinforcing bars, the inner reinforcing bars, the inner transverse reinforcing bars, and the outer transverse reinforcing bars are buried by the concrete, and forming a solid column of the concrete.

5. The method of claim 4, wherein the first step is performed by connecting the inner transverse reinforcing bars in a state in which the two or three outer main reinforcing bars and the single one of the inner reinforcing bars are fastened to a pair of jigs.

6. The method of claim 4, wherein the second step is performed by installing the plurality of triangular reinforcing bar networks at a location of the column, and then surrounding the plurality of triangular reinforcing bar networks with the outer transverse reinforcing bars.

7. The method of claim 4, wherein, in the second step, all of the plurality of triangular reinforcing bar networks are surrounded with the outer transverse reinforcing bars, forming a column reinforcing bar network, and then the column reinforcing bar network is lifted by a crane and relocated at a target location at which the solid reinforced concrete column is to be located.

8. The method of claim 4, wherein, in the second step, a predetermined number of the plurality of triangular reinforcing bar networks are simultaneously hung on a dedicated jig and lifted by a crane and placed at a target location at which the solid concrete column is to be located, and, when all of the plurality of triangular reinforcing bar networks are placed at the target location, the plurality of triangular reinforcing bar networks are surrounded with the outer transverse reinforcing bars.

9. The method of claim 4, wherein the second step is performed by burying a guide plate, in which reinforcing bar receiving holes are formed, in an upper portion of a base part, and then installing the triangular reinforcing bar networks in such a way as to insert the outer main reinforcing bars or inner reinforcing bars into the reinforcing bar receiving holes of the guide plate.

10. The method of claim 4, wherein the single one of the inner reinforcing bars includes an inner side which faces a center of the concrete column and an outer side opposite to the inner side, and wherein the inner side is connected to and in contact with a corresponding one of the inner transverse reinforcing bars, and the outer side is surrounded by the concrete without being connected to another transverse reinforcing bar.

11. A method of constructing the solid reinforced concrete column of claim 2, comprising:

a first step of assembling each triangular reinforcing bar network by connecting the two or three outer main reinforcing bars and the single one of the inner reinforcing bars by each of the inner transverse reinforcing bars; then a second step of arranging the plurality of triangular reinforcing bar networks and then surrounding an outside of the plurality of triangular reinforcing bar networks with the outer transverse reinforcing bars; and then a third step of placing the concrete such that the outer main reinforcing bars, the inner reinforcing bars, the inner transverse reinforcing bars, and the outer transverse reinforcing bars are buried by the concrete, and forming a solid column of the concrete.

12. The method of claim 11, wherein the first step is performed by connecting the inner transverse reinforcing bars in a state in which the two or three outer main reinforcing bars and the single one of the inner reinforcing bars are fastened to a pair of jigs.

13. The method of claim 11, wherein the second step is performed by installing the plurality of triangular reinforcing bar networks at a location of the column, and then surrounding the plurality of triangular reinforcing bar networks with the outer transverse reinforcing bars.

14. The method of claim 11, wherein, in the second step, all of the plurality of triangular reinforcing bar networks are surrounded with the outer transverse reinforcing bars, forming a column reinforcing bar network, and then the column reinforcing bar network is lifted by a crane and relocated at a target location at which the solid reinforced concrete column is to be located.

15. The method of claim 11, wherein, in the second step, a predetermined number of the plurality of triangular reinforcing bar networks are simultaneously hung on a dedicated jig and lifted by a crane and placed at a target location at which the solid concrete column is to be located, and, when all of the plurality of triangular reinforcing bar networks are placed at the target location, the plurality of triangular reinforcing bar networks are surrounded with the outer transverse reinforcing bars.

16. The method of claim 11, wherein the second step is performed by burying a guide plate, in which reinforcing bar receiving holes are formed, in an upper portion of a base part, and then installing the triangular reinforcing bar networks in such a way as to insert the outer main reinforcing bars or inner reinforcing bars into the reinforcing bar receiving holes of the guide plate.

* * * * *